US011186960B2

(12) United States Patent
Obermeyer

(10) Patent No.: US 11,186,960 B2
(45) **Date of Patent: *Nov. 30, 2021**

(54) WATER CONTROL GATE ANCHORING METHODS

(71) Applicant: Henry K. Obermeyer, Wellington, CO (US)

(72) Inventor: Henry K. Obermeyer, Wellington, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/928,756

(22) Filed: Mar. 22, 2018

(65) Prior Publication Data

US 2018/0209111 A1 Jul. 26, 2018

Related U.S. Application Data

(63) Continuation of application No. 15/327,354, filed as application No. PCT/US2015/041214 on Jul. 20, 2015, now Pat. No. 9,957,681.

(Continued)

(51) Int. Cl.

| | |
|---|---|
| ***E02B 7/44*** | (2006.01) |
| ***E02B 7/54*** | (2006.01) |
| ***E02B 7/00*** | (2006.01) |
| ***E02B 8/00*** | (2006.01) |
| ***E05D 1/00*** | (2006.01) |
| ***E05D 7/00*** | (2006.01) |

(52) U.S. Cl.

CPC ..... *E02B 7/44* (2013.01); *E02B 7/005* (2013.01); *E02B 7/54* (2013.01); *E02B 8/00* (2013.01); *E05D 1/00* (2013.01); *E05D 7/00* (2013.01); *E05Y 2900/40* (2013.01)

(58) Field of Classification Search

CPC ..... E02B 7/005; E02B 7/20; E02B 7/40; E02B 7/42; E02B 7/44; E02B 8/00

USPC ..... 405/87, 91, 94, 115, 100

See application file for complete search history.

(56) References Cited

U.S. PATENT DOCUMENTS

| | | | |
|---|---|---|---|
| 2,551,695 | A | 3/1951 | Oody |
| 3,355,851 | A | 12/1967 | Imbertson et al. |
| 3,877,281 | A | 4/1975 | Shimizu et al. |
| 3,975,915 | A | 8/1976 | Haw |

(Continued)

FOREIGN PATENT DOCUMENTS

| | | | |
|---|---|---|---|
| EP | 0054289 | A | 6/1982 |
| EP | 1043356 | B1 | 12/2009 |
| GB | 1051501 | A | 12/1966 |

(Continued)

OTHER PUBLICATIONS

International Application No. PCT/US15/41214; International Search Report dated Oct. 15, 2015.

(Continued)

*Primary Examiner* — Frederick L Lagman

(57) ABSTRACT

The present invention relates to inflatable bladder actuated water control gates for control of open channels such as rivers and canals and for control of dam spillways without the need for intermediate piers. The air bladder and hinge flap wedge clamping system includes hinged engagement of the upstream edge of the clamps to the foundation so as to prevent the application of bending and shear loads to the anchor bolts. The resulting configuration facilitates the use of high strength alloy steel anchor bolts in a corrosion protected environment and also prevents tensile loading of the concrete foundation and associated cracking of the concrete foundation.

6 Claims, 10 Drawing Sheets

Related U.S. Application Data

(60) Provisional application No. 62/026,540, filed on Jul. 18, 2014.

(56) References Cited

U.S. PATENT DOCUMENTS

| | | | | |
|---|---|---|---|---|
| 4,780,024 | A | 10/1988 | Obermeyer et al. | |
| 4,836,711 | A * | 6/1989 | Sala | E02B 7/42 16/222 |
| 5,092,707 | A | 3/1992 | Obermeyer | |
| 5,709,502 | A | 1/1998 | Obermeyer | |
| 5,713,699 | A | 2/1998 | Obermeyer | |
| 6,213,683 | B1 * | 4/2001 | Muramatsu | E02B 7/005 405/115 |
| 9,957,681 | B2 * | 5/2018 | Obermeyer | E02B 7/44 |
| 2012/0047830 | A1 * | 3/2012 | Phuly | E02D 27/42 52/294 |
| 2012/0291380 | A1 * | 11/2012 | Tooman | E02D 31/002 52/297 |
| 2013/0156503 | A1 | 6/2013 | Obermeyer | |

FOREIGN PATENT DOCUMENTS

| | | | |
|---|---|---|---|
| JP | 59213812 | A | 12/1984 |
| JP | 60119809 | A | 6/1985 |

OTHER PUBLICATIONS

International Application No. PCT/US15/41214; Written Opinion of the International Searching Authority dated Oct. 15, 2015.
Parent U.S. Appl. No. 15/327,354, filed Jan. 18, 2017.

* cited by examiner

WATER CONTROL GATE ANCHORING METHODS

This application is a continuation of, and claims the benefit of and priority to, U.S. patent application Ser. No. 15/327,354, filed Jan. 18, 2017, now U.S. Pat. No. 9,957,681, which itself is the United States National Stage of International Application No. PCT/US2015/41214, filed Jul. 20, 2015 (It is noted that Jul. 18, 2015 was a Saturday, making this patent application due Jul. 20, 2015), which claims benefit of and priority to U.S. Provisional Application No. 62/026,540 filed Jul. 18, 2014. Each said application is incorporated herein by reference.

FIELD OF INVENTION

The present invention relates to the anchoring system for inflation operated bottom hinged water control gates. Such gates may be used, for example, for water storage, river diversion, hydropower impoundments, flood control, sea water barriers, spillway control, and the like.

DESCRIPTION OF RELATED ART

Prior art bottom hinged water control gates include gates operated by hydraulic cylinders from above, gates operated from hydraulic cylinders from below, gates operated by torque tubes extending into piers or abutments, overhead hoist operated gates, as well as pneumatically actuated bottom hinged gates.

Inflation operated water control gates are well known. Prior art includes U.S. Pat. No. 4,780,024 to Obermeyer et al; U.S. Pat. No. 5,092,707 to Henry K. Obermeyer; U.S. Pat. No. 5,538,360 to Henry K. Obermeyer; U.S. Pat. No. 5,642,963 to Henry K. Obermeyer; U.S. Pat. No. 5,709,502 to Henry K. Obermeyer; U.S. Pat. No. 5,713,699 to Obermeyer et al. Such inflation operated water control gates generally incorporate an inflatable bladder for actuation in conjunction with a reinforced elastomeric hinge to pivotably secure each gate panel along its lower edge. It should be noted that the preceding description is for a typical gate. Other examples may be located within a closed conduit and mounted in an inverted position with the hinge on top so as to be able to discharge sand, for example, without obstruction of the hinge mechanism by the sand being controlled.

Inflation operated gates in accordance with the aforementioned prior art require that the anchor bolts carry, not only vertical tensile loads, but also shear and bending loads in the horizontal upstream-downstream direction while the concrete surrounding these anchor bolts is subjected to corresponding horizontal loads.

SUMMARY OF INVENTION

The present invention relates to an improved inflatable bladder and hinge flap clamping and retention means.

As is generally the case for structures subject to gravitational loads, the stresses in water control gates increase in proportion to gate height, if the proportions of the gate are simply scaled with height. As anchor bolts are scaled with height in order to hold stress levels constant, the large diameter-to-spacing ratio that results as gate system height is increased from 3 meters to 8 meters, for example, results in heavy large diameter anchor bolts, nuts and washers and heavy clamp castings. Long term serviceability of the gate system requires protection from corrosion. The cost of using stainless steel for the anchor bolts and associated nuts and washers increases with damming height. These costs may be mitigated in accordance with the present invention by isolating the anchor bolts from horizontal loads so that they do not need to be sized to resist bending in conjunction with transmitting the horizontal loads between the clamp castings and the concrete foundation at the interface between the pivot edge of the clamp casting and a corresponding pivot surface within the upstream embed. The additional costs of higher gate systems may be further mitigated in accordance with the present invention by providing corrosion protection to the anchor bolt-nut-washer assembly so that a long service life may be assured without resorting to the use of stainless steel. For moderately sized water control gates (up to approximately 3 meters high) of similar configuration. horizontal loads may generally be resisted by anchor bolts of sufficient diameter to resist the resulting bending moments. In the case of water control gates with higher damming heights (5 to 10 meters high, for example), it is more difficult and expensive to provide anchor bolts of sufficient diameter so it is desirable to provide a load path for the usually predominate upstream loads and for the occasional downstream loads separate from the anchor bolts. The provision of a separate load path for horizontal loads not only eliminates undesirable bending moments in the anchor bolts, it also facilitates the use of a flexible or compressible sleeve around the anchor bolts which might otherwise not be able to withstand the resulting lateral compressive loads. A further benefit of the provision of a separate path for horizontal loads is that the relatively thin concrete adjacent to the butt end of the air bladder and hinge flap wedge assemblies is less likely to be broken. Without a sleeve for the anchor bolt, this thin portion of concrete is generally subjected to tensile stresses due to elastic elongation of the anchor bolts in the vertical direction. Without a separate horizontal load path, this portion of concrete may be subjected to tensile loads that cause it to crack and spall off in response to impact loads in the downstream direction to the gate panels. The unique combination of upstream/downstream constraint and a sleeved anchor bolt greatly reduces the likelihood of concrete failure upstream of the air bladder and hinge flap wedges. The concrete in this area may be further protected from cracking or failure by means of an embedded plate or channel, for example, preferably of stainless steel construction. Said embedded plate or channel may serve to align the anchor bolts during concrete placement and is preferably provided with holes to allow air and water escape during concrete placement and to facilitate the addition of concrete as needed to eliminate any voids under said plate or channel.

The provision of a sleeve around the anchor bolts also serves to minimize tensile stresses in the foundation slab in the general vicinity of the anchor bolts. By providing vertical compressive stresses in the concrete, a tri-axial compressive stress state may be established in the concrete as the horizontal tensile loads are assumed by the higher modulus steel reinforcement. The resulting tri-axial stress state in the concrete results in a structurally better foundation while minimization of cracking serves to protect the steel reinforcement from corrosion.

The cost of high strength stainless steel anchor bolts may be unacceptably high in the case of high gate systems. The use of high strength heat-treated alloy steel anchor bolts is facilitated in accordance with the present invention because such non-stainless steel anchor bolts may be readily protected from corrosion.

In accordance with a preferred embodiment of the invention, the clamps are provided with pivotal constraint along their upstream edges so as to limit horizontal movement along the upstream-downstream axis during initial tightening and while in service. Said pivotal constraint provides a load path for horizontal loads due, for example, to rock, ice, or debris impact against the ribs of the lowered gate panel. In accordance with a further aspect of this invention, the range of pivoting motion of the clamp during assembly of the gate system is great enough to allow compression of the rubber components from the relaxed as-placed-onto-spillway state to the fully assembled tightened state which eliminates the need or compression of the assembly by other means, such as a hydraulic excavator bucket. Such range of motion requires extra clearance in the clamp casting to clear the anchor bolt as the clamp casting pivots downward and also requires sufficient clearance between the upstream edge of the upper surface of the clamp casting and the foundation to not cause interference as the clamp is initially placed onto the upstream embed and the uncompressed rubber assembly.

In accordance with a further aspect of this invention a wedge shaped gap may be provided between the upstream edge of the clamp and the adjoining embed surface so as to allow, during clamp installation, the pivot edge of the clamp to seat against the pivot embed in the foundation prior to tightening of the anchor bolt. Preferably, and in accordance with a further aspect of this invention, the holes in the clamps around the anchor bolts are relieved so as to provide clearance between the clamps and the bolts through a range of clamp positions inclusive of the initial inclined position atop an uncompressed and un-deformed air bladder and hinge and the in-service position of the installed and fully tightened clamps.

In accordance with a further aspect of this invention, clearance between the clamps and the anchor bolts, as well as clearance between the clamps and the foundation, allow for periodic re-tightening of the clamps over the life of the rubber components, taking into account compression set and creep of the rubber.

In accordance with a further aspect of this invention, a filler such as silicone RTV caulk may be used to occlude sand and gravel from said wedge shaped gap.

The provision of sleeves around the anchor bolts also serves to minimize tensile stresses in the foundation slab in the general vicinity of the anchor bolts. By providing vertical compressive stresses in the concrete, a tri-axial compressive stress state may be established in the concrete as the horizontal tensile loads are assumed by the higher modulus steel reinforcement. Explain further. The resulting tri-axial stress state in the concrete results in a structurally better foundation while minimization of cracking serves to protect the steel reinforcement from corrosion.

The cost of high strength stainless steel anchor bolts may be unacceptably high in the case of high gate systems. The use of high strength heat treated alloy steel anchor bolts is facilitated in accordance with the present invention because such non-stainless steel anchor bolts may be readily protected from corrosion. The means of corrosion protection in accordance with the present invention may be comprised of one or more of the following elements:

1) A clamp casting anchor bolt hole cover. Such a cover may be rigid and bolted in place, for example. Alternatively a cover in the form of a rubber plug may be retained in each clamp casting anchor bolt hole by means of a lip at the interior top of the clamp casting anchor bolt hole. In the case of a rubber plug, a smaller plug within the larger plug may be provided to facilitate the release of air during insertion of the larger plug and to facilitate filling the cavities within the clamp casting with a water and oxygen displacing substance as described below.
2) A compressible seal around each anchor bolt situated between the clamp casting and the foundation. The compressible seal is preferably configured to seal simultaneously against a) the anchor bolt (or its sleeve), b) the foundation, and c) the clamp.
3) A water and oxygen displacing substance such as grease, paraffin, or bee's wax, substantially filling the space within the clamp casting around each anchor bolt and its nut and washer assembly.
4) An impervious and crack resistant sealing surface surrounding the anchor bolts against which said compressible seal may be seated.

DETAILED DESCRIPTION OF THE PREFERRED EMBODIMENTS

Figure 1:
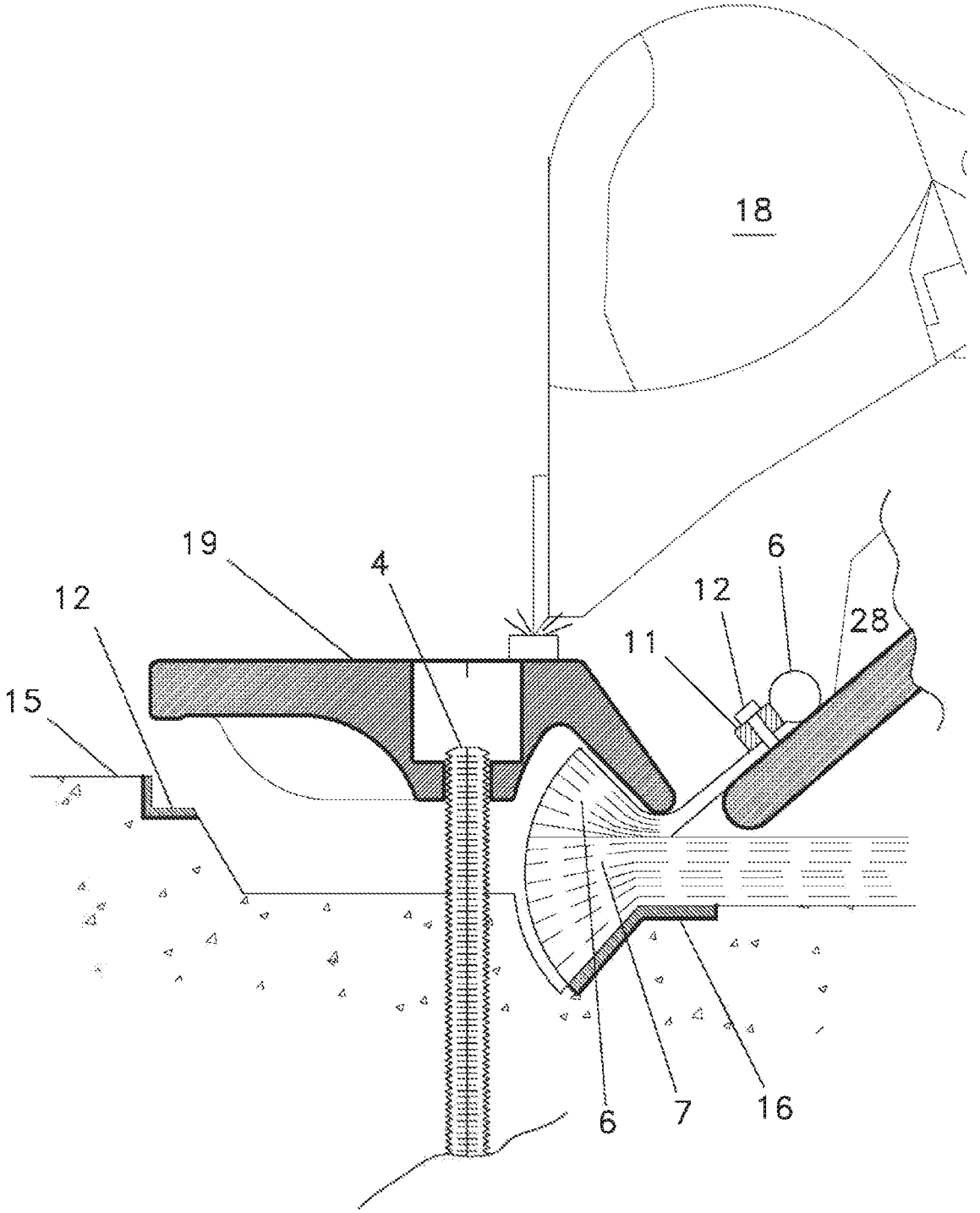
PRIOR ART Fig. 1
FIG. 1 is a sectional elevation of the anchor bolt and clamping assembly portion of a water control gate in accordance with prior art.

Referring to FIG. 1, prior art shows that compression of hinge flap 6 and air bladder 7 may require an externally applied downward force on clamp casting 19 such as from a hydraulic excavator bucket 18. It should be noted that the term "clamp casting" is used herein to describe the clamps which, although commonly cast, might also be made by forging, flame cutting, or additive manufacturing, for example.

Figure 2:
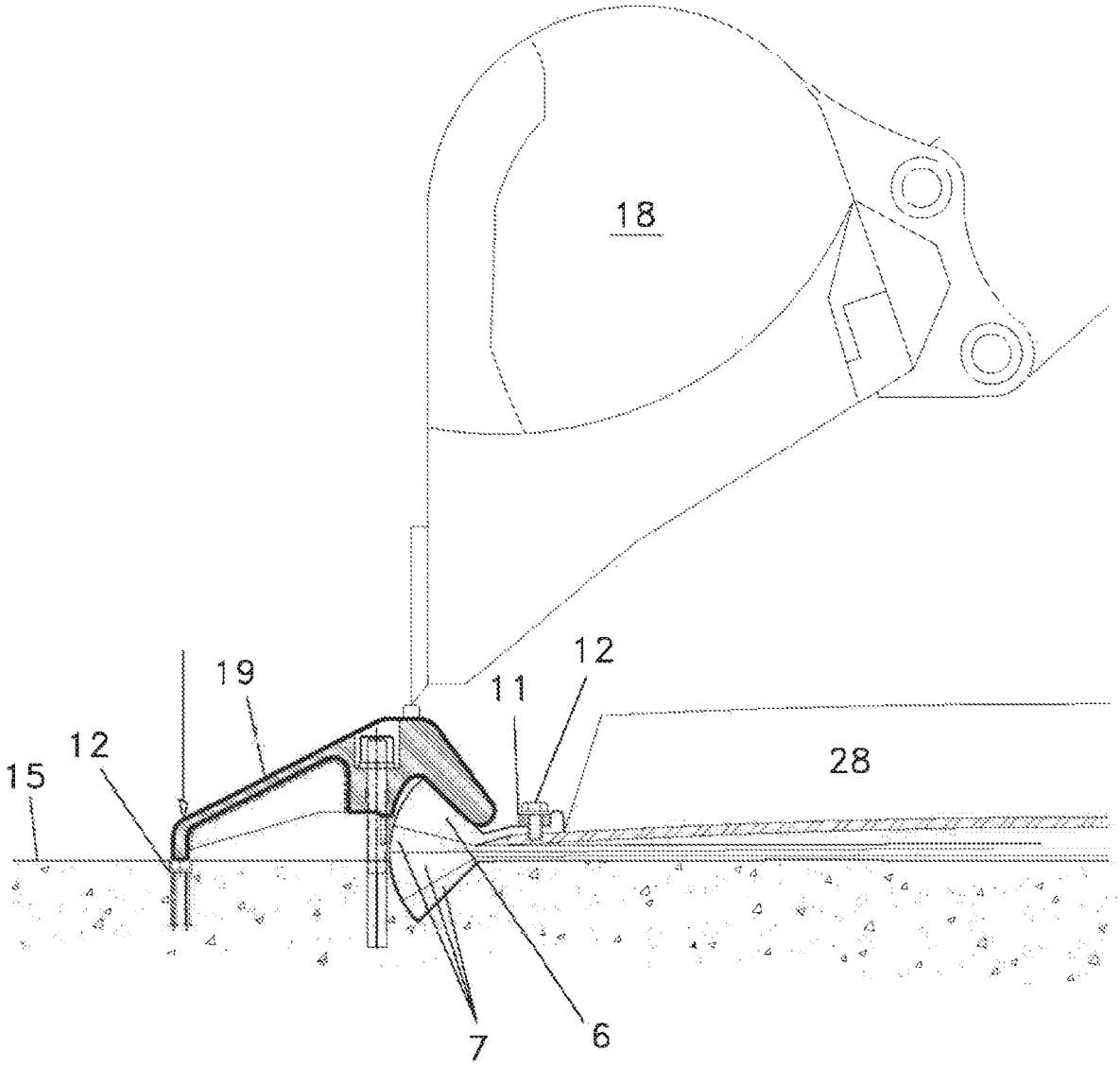
PRIOR ART Fig. 2
FIG. 2 is a sectional elevation of another anchor bolt and clamping assembly portion of a water control gate in accordance with prior art, shown during installation.

Referring to FIG. 2, prior art shows an external force such as from a hydraulic excavator bucket 18 may be required to seat non-pivoting clamp 19 against hinge flap 6 and air bladder 7.

Figure 3:
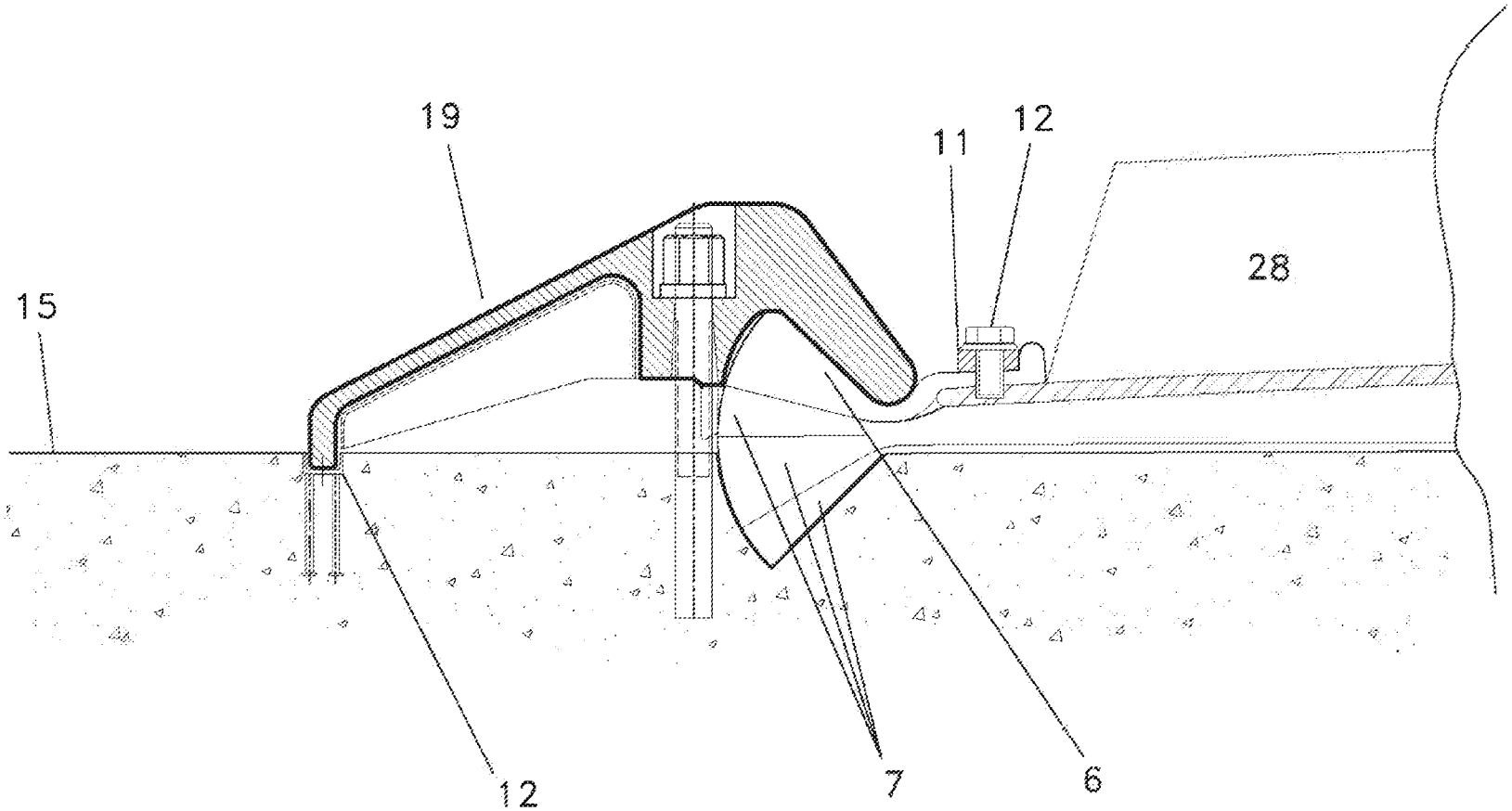
PRIOR ART Fig. 3
FIG. 3 is a sectional elevation of the anchor bolt and clamping assembly portion of the water control gate assembly in accordance with prior art of FIG. 2, shown with the clamp installed.

Referring to FIG. 3, prior art clamp 19 is shown in its installed position against hinge flap 6 and air bladder 7. Upstream embed 12 in spillway (foundation) 15 provides horizontal restraint to clamp casting 19 once installation is complete. Gate panel 28 is shown attached to hinge flap 6 by means of hinge retainer 11 and bolt 12.

Figure 4:
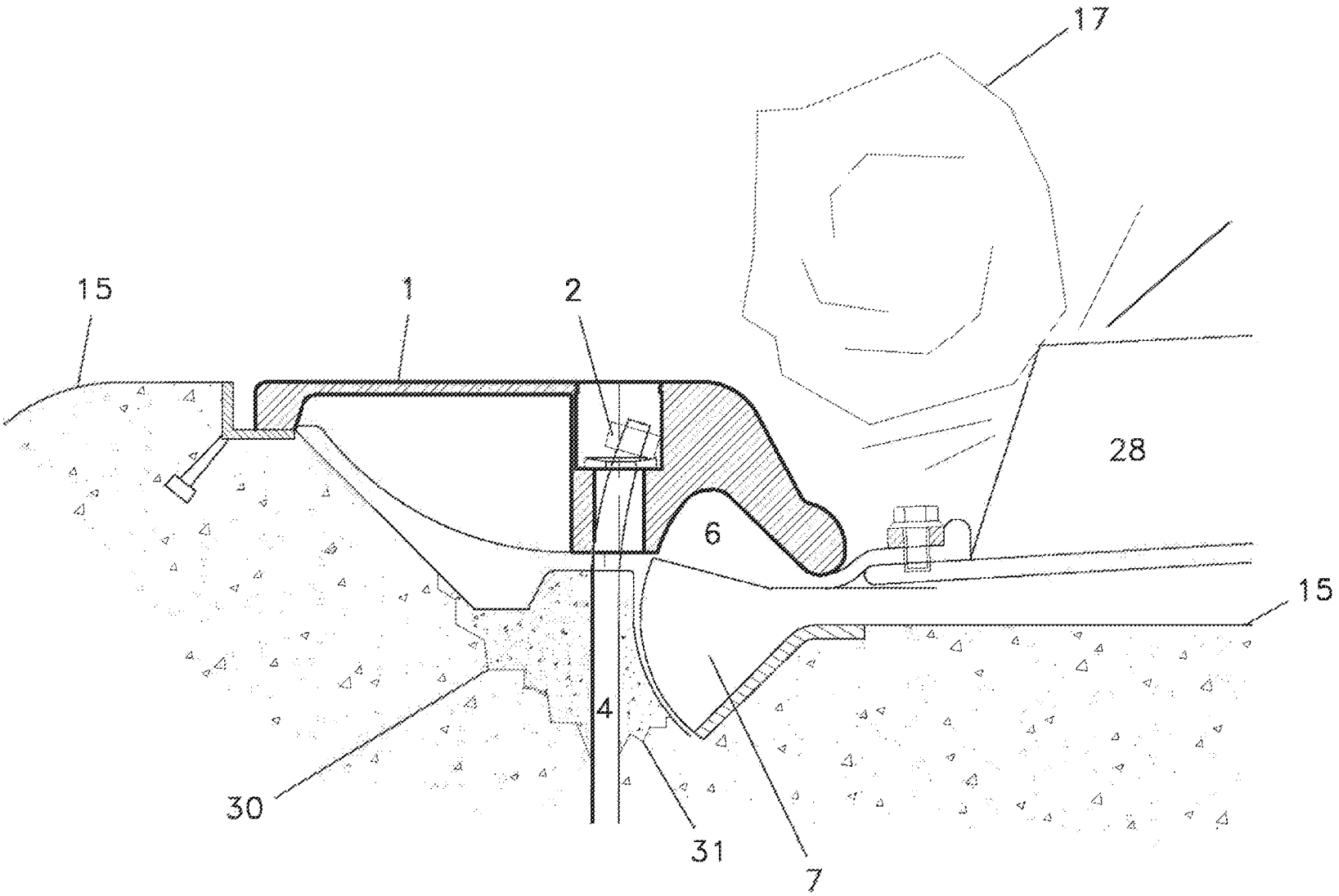
PRIOR ART Fig. 4
FIG. 4 is a sectional elevation of the anchor bolt and clamping assembly of a prior art water control gate shown as affected by impact of a boulder to a gate panel rib.

Referring to FIG. 4, prior art clamp 1 has moved downstream in response to an impact by boulder 17 to gate panel 28, causing anchor bolt 4 to bend and causing cracks 30 and 31 in foundation 15.

Figure 5:
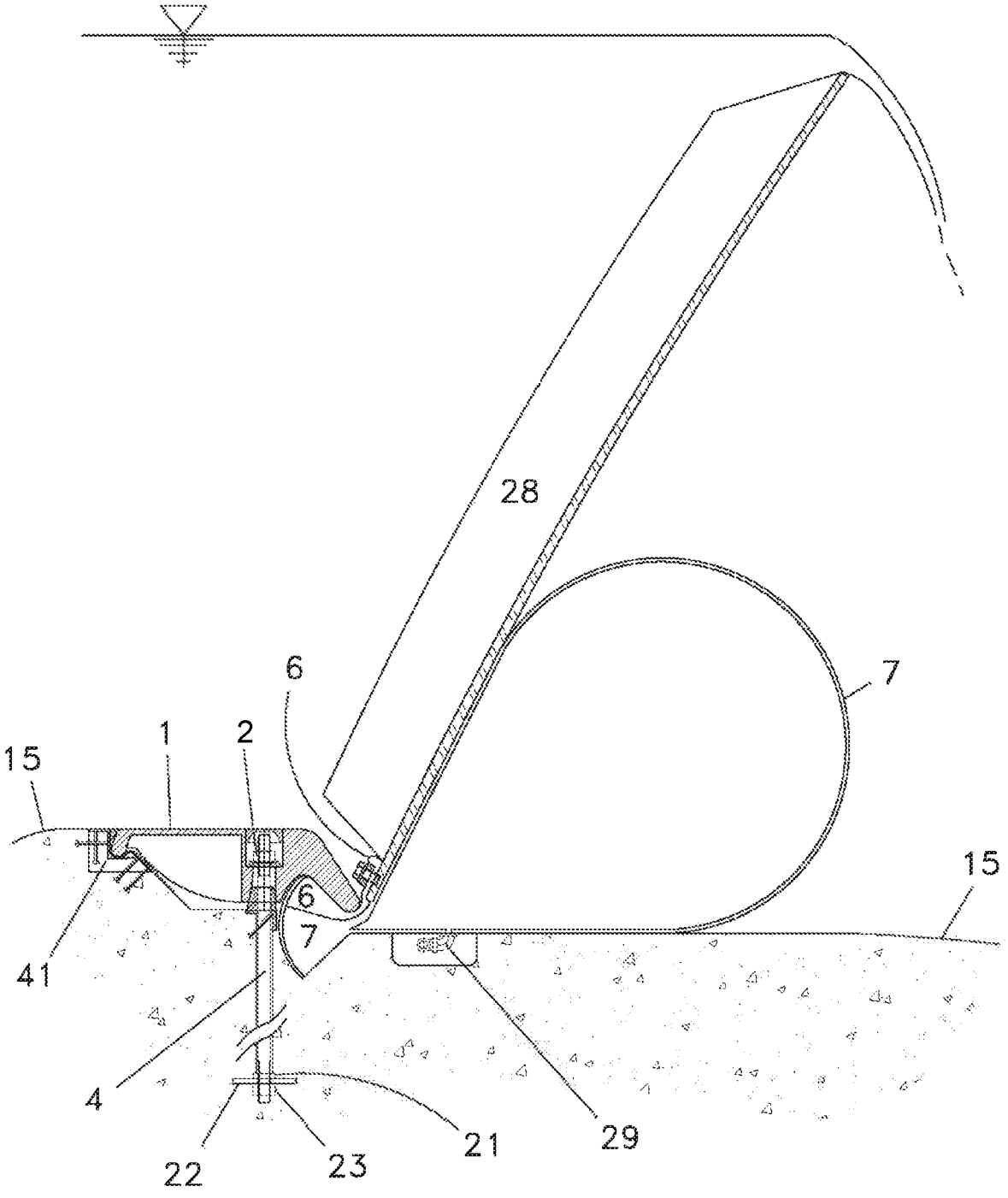
FIG. 5 is a sectional elevation of a water control gate in accordance with the present invention.

Referring to FIG. 5, a sectional elevation through a water control gate system in accordance with the present invention is shown. Clamp casting 1 holds in place hinge flap 6 and air bladder 7. Clamp casting 1 is in turn held in place vertically by anchor bolt 4 in conjunction with nut 2, spherical washer 3, lower nut 23, lock nut 21, and anchor plate 22. Clamp casting 1 is held in place horizontally by upstream embed 41. The mating cylindrical surfaces of clamp casting 1 and upstream embed 41 act as a hinge during the assembly process and act to horizontally restrain clamp casting 1 after installation. Air connection 29 is used to control the air volume and pressure in bladder 7. It should be noted that the term "air bladder" is used herein to describe the inflatable actuator used to control the gate panel 28. Air bladder 7 might also be inflated with water, freeze-resistant solution, or nitrogen gas, for example.

Figure 6:
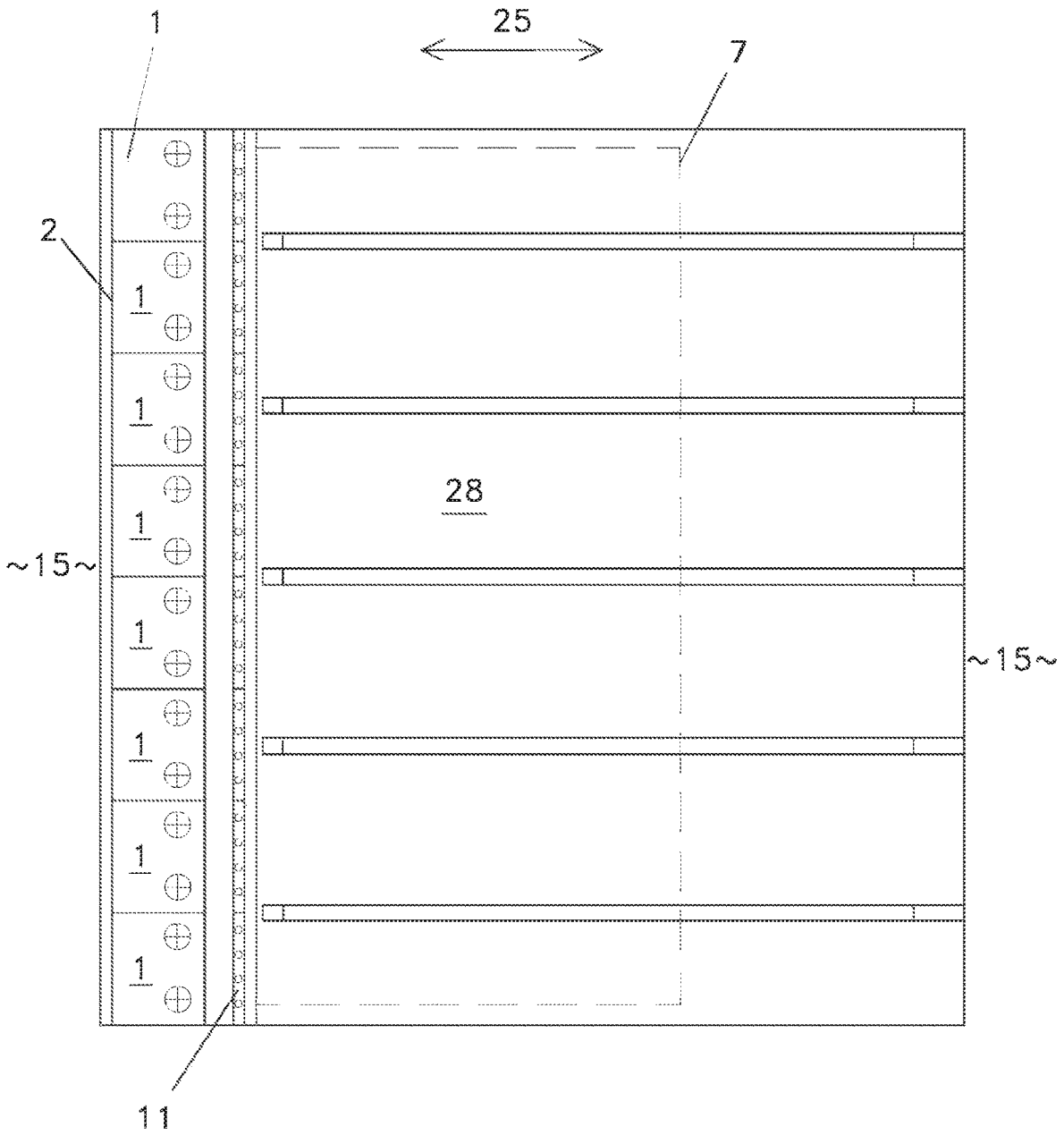
FIG. 6 is a plan view of the water control gate of FIG. 5.

Referring to FIG. 6, a plan view of the water control gate system of FIG. 5 is shown in its lowered position. Clamp castings 1 secure hinge flap 6 to spillway 15. Gate panel 28 is secured by hinge flap 6 which is in turn secured by clamp castings 1.

Figure 7:
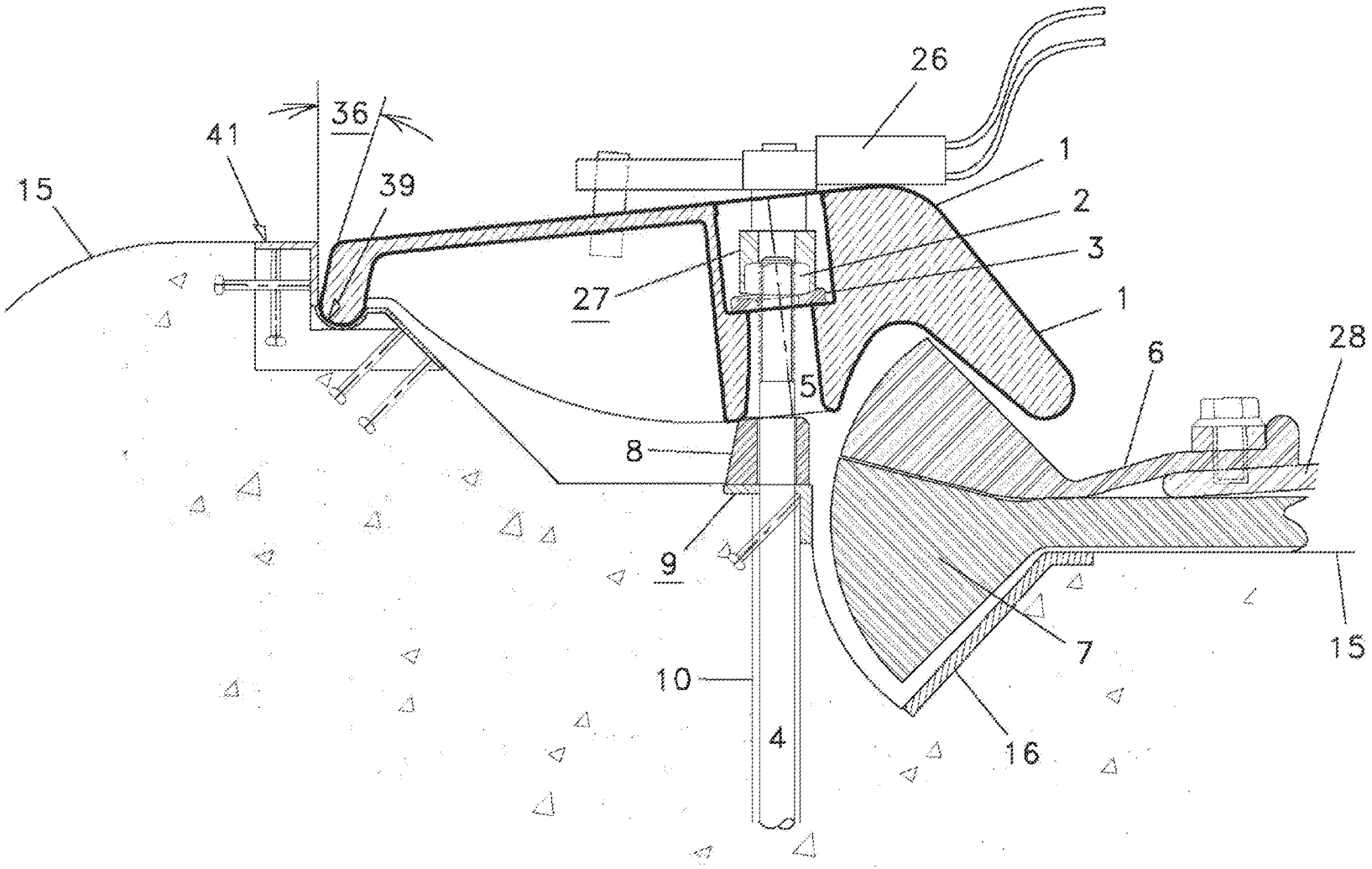
FIG. 7 is a sectional elevation of the clamping assembly of a water control gate in accordance with the present invention, shown during installation.

Referring to FIG. 7, a sectional elevation of the clamping assembly in accordance with the present invention is shown during the installation process. Clamp casting 1 rests on upstream embed 41 and on hinge flap 6. The clamp casting 1 is being tightened against hinge flap 6 by hydraulic torque wrench 26 with socket 27 engaged with spherical nut 2 mated to spherical washer 3. Cavity 5 in clamp casting 1 is shaped to clear anchor bolt 4 throughout its range of motion during installation. In this way anchor bolt 4 is not damaged and the concrete in the vicinity of anchor bolt embed 9 is not damaged. Hinge flap 6 seats against air bladder 7 which in turn seats against wedge embed 16.

Figure 8:
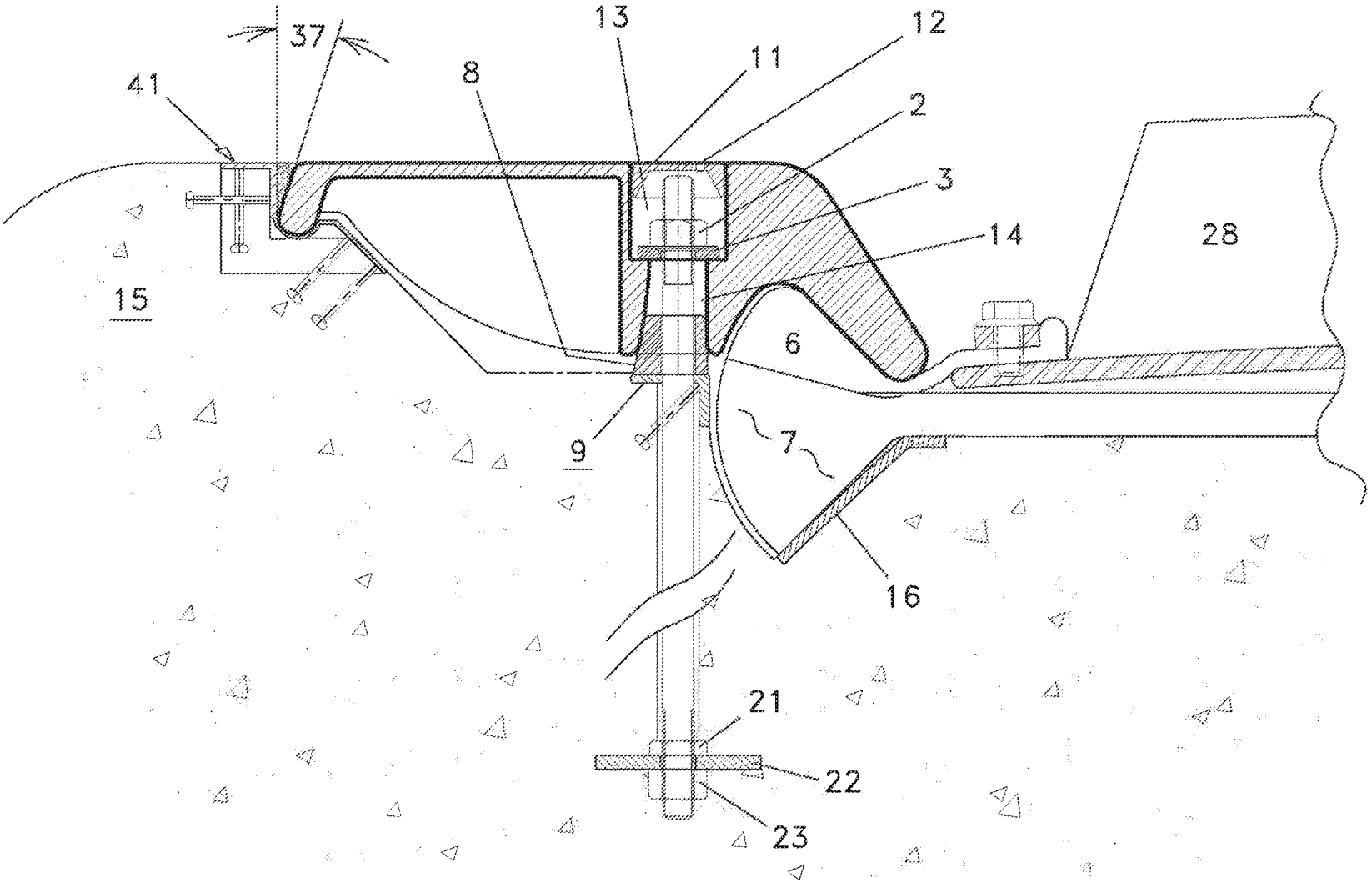
FIG. 8 is a sectional elevation of the clamping assembly of a water control gate in accordance with the present invention, shown installed.

Referring to FIG. 8, the clamping assembly of FIG. 7 is shown after installation. Nut 2 is tight against spherical washer 3 which tightly holds clamp casting 1 against hinge flap 6 and air bladder 7. The anchor bolt 4 exerts its upward force on the concrete through anchor plate 22. Angular gap 37 may be filled with silicone caulk for example to keep out sand and rocks.

Figure 9:
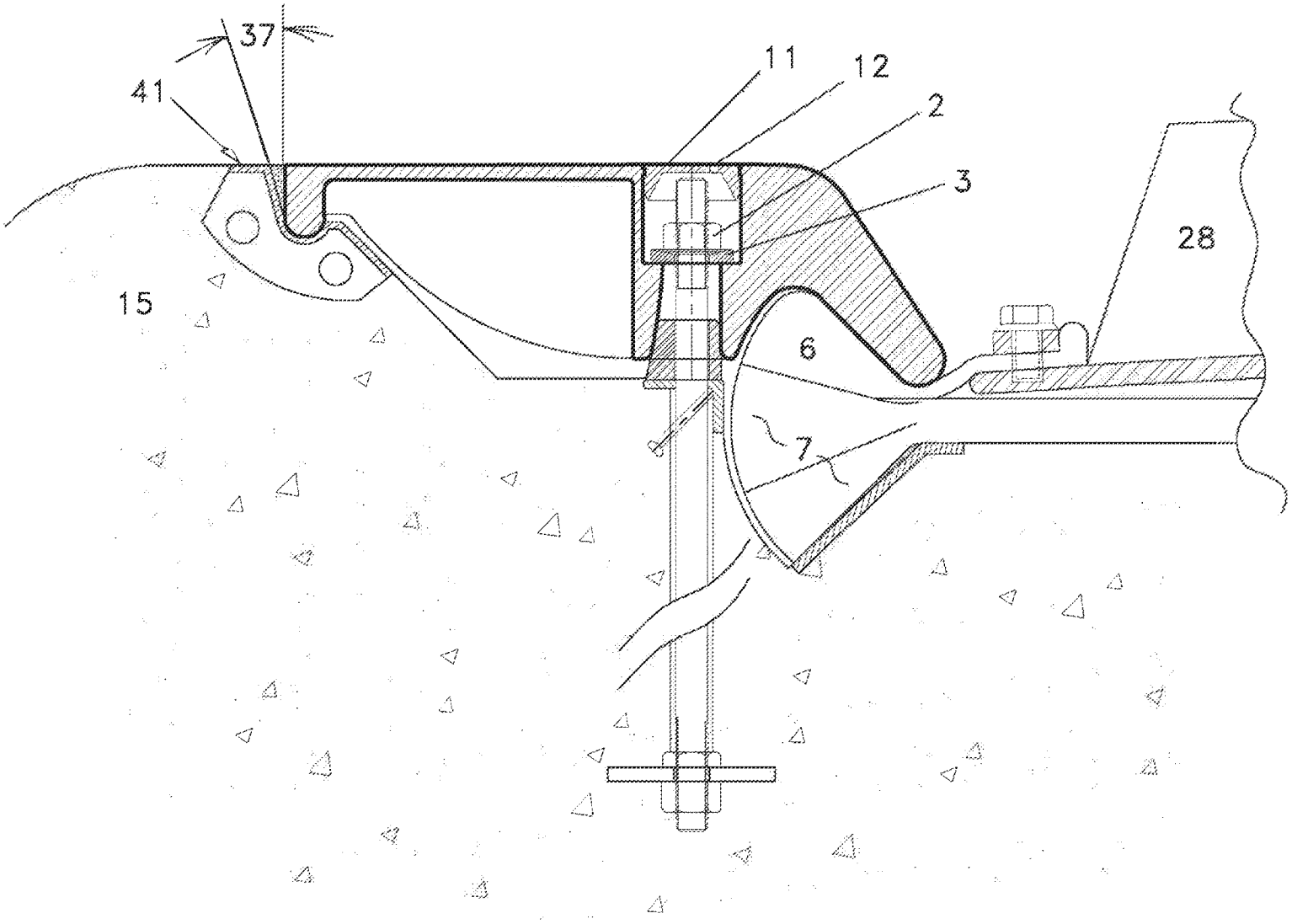
FIG. 9 is a view after installation of the assembly of FIG. 8.

Referring to FIG. 9, angular gap 37, needed for assembly has been provided by tapering the embed rather than the clamp casting 1. In other respects the assembly is the same as that shown in FIG. 7.

Figure 10:
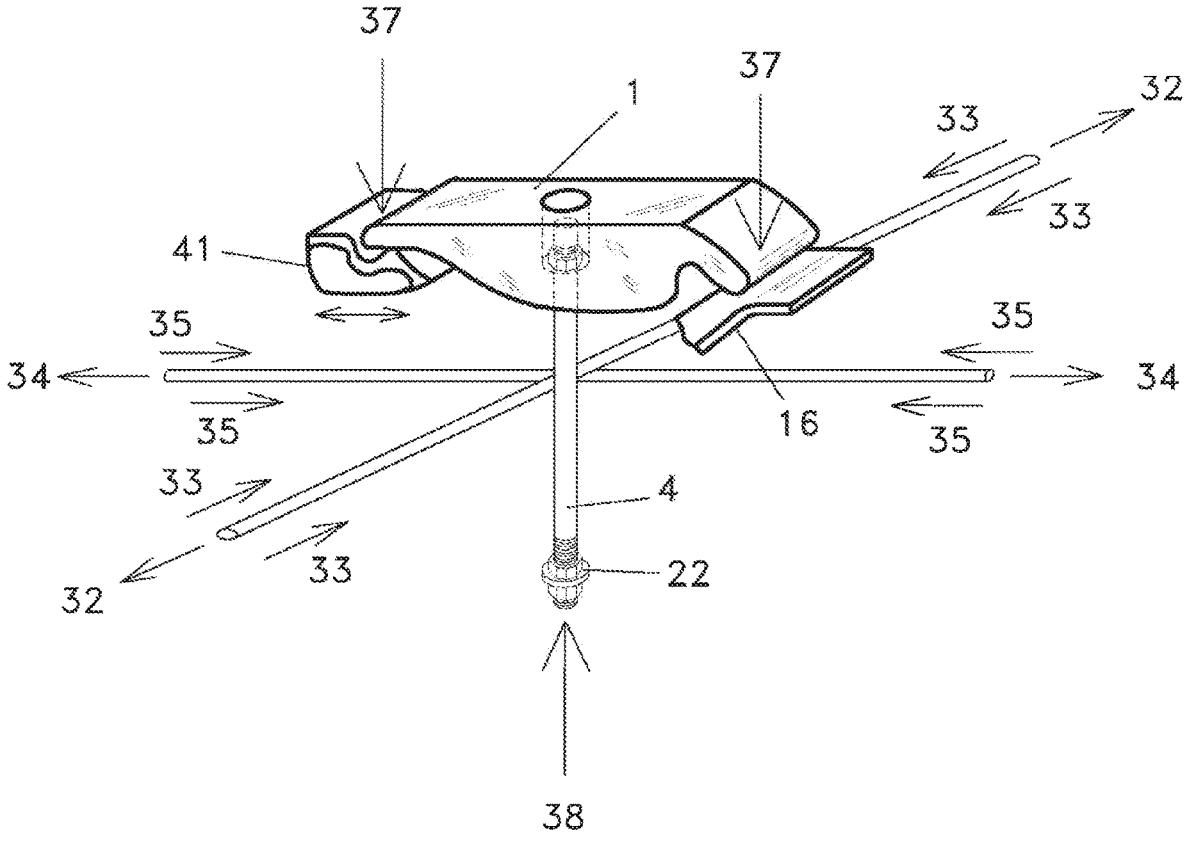
FIG. 10 is an isometric view showing the relationship between foundation loads.

Referring to FIG. 10, the geometric relationship between the anchor bolt 4, vertical forces 37 on pivot embed 41 and wedge embed 16, vertical force 38 on anchor plate 22, upstream/downstream rebar tension 34, upstream/downstream concrete compression 35, transverse rebar tension 32, transverse concrete compression 33. Constraint by the rebar and anchor bolts leaves the concrete in the vicinity of anchor bolts 4 in generally tri-axial compression and thus suppresses cracking in response to shear loads. It should be noted that standard construction practice would provide for rebar both transverse and parallel to the flow and to the spillway axis. The use of such rebar is implied although it is not shown on the drawings in the interest of avoiding clutter.

Referring to FIGS. 5, 6, 7, 8*a* and 8*b*, clamp casting 1 is positively located along the upstream/downstream axis 25 (FIG. 6) by clamp pivot embed 41. Clamp casting 1 is free to pivot in clamp pivot embed 41 in response to adjustment of spherical nut 2. Spherical nut 2 minimizes any bending moments transmitted between anchor bolt 4 and clamp casting 1. Clamp casting anchor bolt hole 5 has sufficient clearance upstream and downstream of anchor bolt 4 to allow clamp casting 1 to be initially positioned, as shown in FIG. 7, over hinge flap 6 and air bladder 7 while kept aligned and positioned by clamp pivot embed 2 and without contacting, scraping, or damaging the upper threads 34 of anchor bolt 4. Gap 22 between clamp casting 1 and the adjacent edge of embed 41 allows clamp 1 to pivot upward without interference. Compressible seal 8 is compressed against clamp casting 1, anchor bolt upper spacer 9, and anchor bolt sleeve 10, keeping water and oxygen out of the clearance 5 between anchor bolt sleeve 10 and clamp casting 1 and also away from the upper un-sleeved portion of anchor bolt 4. Rubber cap 11 in conjunction with rubber plug 12 keeps water from entering through the top of clamp casting 1. The space between clamp casting 1 and anchor bolt 4 may be filled with corrosion preventing material such as grease or paraffin. Optional gap filler 29, which may be silicone caulk for example, serves to prevent sand, gravel, and rocks from falling between the upstream edge of clamp casting 1 and clamp pivot embed 41. The gap filler may be replaced as needed. Anchor bolt sleeve 10 may be a PVC plastic tube, a rubber tape wrapped around the pipe, or other material that is either compliant in shear or that does not bond to the concrete.

As can be easily understood from the foregoing, the basic concepts of the present invention may be embodied in a variety of ways. It involves both water control gates or other devices to accomplish the appropriate method. In this application, the inflatable actuation methods are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims which are included in this patent application.

What is claimed is:

1. A system for clamping a water control gate to a spillway by use of the following elements to pivotally clamp a water control gate to a spillway:

at least one hinge flap, an air bladder, at least one clamp casting to hold said at least one hinge flap and said air bladder in place, wherein said clamp casting is in turn held in place vertically by at least one anchor bolt and nut assembly, wherein said anchor bolt and nut assembly comprises a nut, a spherical washer, a lower nut, a lock nut, and an anchor plate, an upstream and downstream embed;

wherein said clamp casting is held in place horizontally by said upstream embed, and an anchor plate, a sealant to occlude water from the said anchor bolt and nut assembly, wherein said sealant comprises a clamp casting anchor bolt hole cover; a compressible rubber seal with an upper end and a lower end; an anchor bolt upper spacer; and a water and oxygen displacing substance; and an air connection.

2. A system for clamping a water control gate to a spillway as described in claim 1 further comprising creating a sleeved anchor bolt portion.

3. A system for clamping a water control gate to a spillway as described in claim 2 further comprising sufficient clearance between the sleeved anchor bolts and the clamp casting holes to allow compression of the rubber seal using said nut without resulting in damaging contact between the anchor bolt and the clamp casting during assembly.

4. A system for clamping a water control gate to a spillway as described in claim 2 further comprising the sleeve portion of said sleeved anchor bolt may be made of PVC plastic tube, a rubber tape wrapped around the pipe, that is either compliant in shear or that does not bond to the concrete.

5. A system for clamping a water control gate to a spillway as described in claim 1 wherein said anchor bolt exerts upward force on said spillway through said anchor plate.

6. A system for clamping a water control gate to a spillway as described in claim 1 wherein said air connection is used to control the air volume and pressure in said air bladder.

* * * * *